US005651548A

United States Patent [19]

French et al.

[11] Patent Number: 5,651,548

[45] Date of Patent: Jul. 29, 1997

[54] GAMING CHIPS WITH ELECTRONIC CIRCUITS SCANNED BY ANTENNAS IN GAMING CHIP PLACEMENT AREAS FOR TRACKING THE MOVEMENT OF GAMING CHIPS WITHIN A CASINO APPARATUS AND METHOD

[75] Inventors: John French; William Piehl, both of San Clemente, Calif.

[73] Assignee: Chip Track International, Carson City, Nev.

[21] Appl. No.: 444,566

[22] Filed: May 19, 1995

[51] Int. Cl.[6] ..... A63F 9/24

[52] U.S. Cl. ..... 273/309; 273/237; 273/288; 463/29; 463/12; 463/13; 463/25; 364/412; 40/27.5

[58] Field of Search ..... 273/146, 237, 273/309, 238, 288; 463/22, 25, 29, 12, 13; 364/412; 194/214; 40/27.5

[56] References Cited

U.S. PATENT DOCUMENTS

| | | | |
|---|---|---|---|
| 3,766,452 | 10/1973 | Burpee et al. | 40/27.5 |
| 4,755,941 | 7/1988 | Bacchi | 364/412 |
| 4,818,855 | 4/1989 | Mongeon et al. | 235/440 |
| 5,007,641 | 4/1991 | Seidman | 273/138 A |
| 5,159,549 | 10/1992 | Hallman, Jr. et al. | 364/412 |
| 5,166,502 | 11/1992 | Rendleman et al. | 235/492 |
| 5,179,517 | 1/1993 | Sarbin et al. | 364/410 |
| 5,265,874 | 11/1993 | Dickinson et al. | 273/138 A |
| 5,361,885 | 11/1994 | Modler | 194/214 |

OTHER PUBLICATIONS

British Technology Group Ltd., News Release, "Innovative Supertag Moves One Step Closer to Reality", 11 Jul. 1994.

"Goodbye UPC–A?", Lisa Terry, ID Systems, vol. 14, No. 9, p. 14, Sep. 1994.

Racom Systems, Inc., "LFM Series Contactless Digital Memory Cards", copyright 1995.

Racom Systems, Inc. Press Release, "Racom Systems Supplies Contactless Smart Cards for Manchester, England", Apr. 4, 1994.

Racom Systems, Inc. Press Release, "Racom Introduces Next Generation Contactless Card System", Jan. 30, 1995.

Racom Systems, Inc. Press Release, "Los Angeles Begins Trial of Racom's Contactless Smart Cards", May 10, 1994.

Cotag, "The Power of Programming" brochure, copyright 1988, Cotag International.

Cotag, "Coded Tags" brochure, copyright 1988, Cotag International.

Cotag, "Automatic Identification Systems" brochure, Cotag International Limited.

"NeuroTag System Multiple–Read Active Tag", copyright 1994, Advanced Systems Group International.

"Intelligent Tagging System Multiple–Read Active Tag", copyright 1994, Advanced Systems Group International.

(List continued on next page.)

*Primary Examiner*—Benjamin H. Layno

*Attorney, Agent, or Firm*—Donald E. Stout

[57] ABSTRACT

A method of tracking movement of gaming chips in casino comprising gaming chips each having an electronic circuit which transmits information, and antennas located at gaming chip placement areas. When gaming chips are placed on a first gaming chip placement area within the casino, the antenna at that first gaming chip placement area transmits a radio beam which in effect scans the electronic circuits of the gaming chips. The electronic circuits identify the gaming chips by electronically broadcasting information. Upon moving a first of the gaming chips to a second gaming chip placement area, the antenna at the second gaming chip location transmits a radio beam which scans the electronic circuit of the first gaming chip. The electronic circuit in the first gaming chip identifies the first gaming chip on the second gaming chip placement area so that the location of the first gaming chip is tracked. The gaming chip placement areas may be at various places such as on a gaming table or a gaming chip tray.

24 Claims, 4 Drawing Sheets

OTHER PUBLICATIONS

"The Intelligent Tagging System—Excellence in High Technology Identification Systems", ASGI/Nauta, Inc., 1993, pp. 1–12.

"The ASGI Tag, Industrial Decoder, Antenna and Secure–Monitor", 4 pages, Advanced Systems Group International.

"Antenna Models 5170, 5160, 5140", Telsor Corporation, p. 2.

"Interface Model 3030, Display Reader", Telsor Corporation, Jun. 1989.

"Avid Mini Tracker", Avid.

"Avid Power Tracker II", Avid.

"Telsor RFID Systems", Telsor.

"Telsor Industrial RFID Systems—Functional Information", Telsor.

"The Telsor Portals", Telsor Corporation.

"Tags", pp. 1–2, May 1993, Telsor Corporation.

"Avid Industrial RF/ID Transponders", AVID.

"Tagging Along", Euopean Retail IT Decisions.

"Radio Helps Casinos Spot Big Spenders" Reno Gazette—Journal by James Robbins, Wednesday, Jan. 18, 1995, pp. C1 and C3.

19a
55
39
13
41
49
51
29a
53
29a

28

57
57
29

GAMING CHIPS WITH ELECTRONIC CIRCUITS SCANNED BY ANTENNAS IN GAMING CHIP PLACEMENT AREAS FOR TRACKING THE MOVEMENT OF GAMING CHIPS WITHIN A CASINO APPARATUS AND METHOD

BACKGROUND OF THE INVENTION

Casinos have been subject to a variety of devious unlawful schemes pursuant to which the perpetrators attempt to fraudulently obtain money or credits from the casino. In one such scheme, a blackjack dealer may arrange with a co-conspirator to allow the co-conspirator to "win" large amounts from the house. Individual players have also devised unlawful schemes enabling them to "win" at various gaming tables including blackjack and craps. As a consequence, casinos expend considerable time and effort in observing both players and game operators in an effort to make certain that all of the games are fairly played.

It is known to embed a radio frequency transponder in a gaming chip, and one such construction is shown in Rendleman et al U.S. Pat. No. 5,166,502. The transponder can be tagged with information concerning the chip, such as the chip identity and value. According to this patent, a reading device can be placed in a slot machine to prevent the use of counterfeit gaming chips in the slot machine. However, this does not address the many schemes that have been devised to cheat the house on the gaming tables.

It is also known to employ machine readable identification cards for players of slot machines. This enables a computer to track various information about the player of the slot machine such as that player's win-loss record against the slot machine, the total dollar amount played, the number of times that player played the slot machines, the amount paid out to the player and the number of hours played. This information can then be used to award complimentary features known "comps" or credits to the player.

Attempts have also been made to manually track various information about players at the gaming tables. For example, it is common to attempt to observe various matters such as the amount of the player's buy in, the time played, the average bet of the player and players win-loss record. However, tracking this information manually is difficult, time consuming and often inaccurate.

SUMMARY OF THE INVENTION

This invention solves this problem by providing an apparatus and method which can be used, among other things, to track the location of gaming chips throughout the individual games and the casino. As a consequence, the manpower needed to oversee casino personnel and monitor players is reduced and the opportunities for apprehending an offender are enhanced. This invention also enables the rapid and accurate gathering of considerable information about the gaming activity of each player at the gaming tables, and this can be used for various purposes including the awarding of comps.

This invention is adapted for use with electronically identifiable gaming chips which have been tagged with various information such as an individual identification number which identifies that particular chip and the value of the chip. The movement of the chip can be tracked by electronically identifying the gaming chip at a first gaming chip placement area within the casino. When the gaming chip is moved to second gaming chip placement area within the casino, that chip is again electronically identified as being on the second gaming chip placement area. Consequently, the location of the gaming chip is tracked.

The gaming chip placement areas may be at any of a variety of locations within the casino including on one or more gaming tables, on a gaming chip tray, in the cashier's cage, and in the vault where the chips are stored. The information obtained from the gaming chips, including the present location of the gaming chips, can be stored in a memory.

Another feature of this invention is that all of the gaming chips on a gaming chip placement area can be electronically identified while all of such chips are on that gaming chip placement area. This feature helps adapt this apparatus and method for use with games played on the gaming tables where it is common to place more than one of the chips on a chip placement area as when the player is betting multiple chips or is being paid by the dealer with multiple chips. Consequently, with this invention it is possible to electronically identify each gaming chip of a group of electronically identifiable gaming chips at first gaming chip placement area within the casino, move one or more of such gaming chips to a second gaming chip placement area and electronically identify the gaming chips at the second gaming chip placement area to thereby track the gaming chips.

In addition to preventing the use of counterfeit chips at the gaming tables and being able to disqualify any stolen chips at the gaming tables, the ability to track and identify each of the gaming chips provides many other advantages. For example, the win-loss record of each dealer can be automatically ascertained, and by having players identify themselves with player cards, the win-loss record of each dealer versus each player can also be tracked. Consequently, it becomes more difficult for the dealer to conspire with a particular player in an effort to cheat the house.

This invention provides a gaming table having a game playing surface with such surface having indicia which adapts the surface for a game which uses gaming chips. The surface has at least one gaming chip placement area. The gaming table also includes an antenna for obtaining information from a gaming chip located on the gaming chip placement area. The antenna preferably has a capability for obtaining information from each of a plurality of gaming chips located on the gaming chip placement area. This enables the gaming table and the associated system to accommodate the placement of multiple gaming chips on the gaming chip placement area.

The antenna can be positioned at any suitable location where it can carry out its information gathering function from the gaming chips, i.e. the antenna and gaming chip placement area are located so that the gaming chips at the gaming chip placement area are within the interrogation range of the antenna. In this regard, the antenna is preferably carried by the gaming table closely adjacent the gaming chip placement area. In a preferred construction, the antenna is carried by the gaming table beneath the gaming chip placement area.

The gaming table may have one or more of the gaming chip placement areas. For many of the games, it is preferred that the surface of the gaming table have a plurality of the gaming chip placement areas. In this event, there are preferably a corresponding number of the antennas for obtaining information from a gaming chip located on the associated gaming chip placement area.

The gaming table may be adapted for any of a variety of games which utilize gaming chips, such as blackjack, craps, poker, big six, red dog, sic bo, Pai Gow, roulette and baccarat. In the case of blackjack with n player positions, there may be a first group of the gaming chip placement areas which constitute n player bet placement areas and a second group of the gaming chip placement areas which constitute n player-win placement areas. With this arrangement, information from the gaming chips being bet and the gaming chips being paid to a player can be obtained. In the case of craps, one of the gaming chip placement areas may be a gaming chip storage area so that the information from the gaming chips held at the gaming chip storage area can be obtained.

The gaming table may be used in an apparatus or system which includes various other components. For example, there may be a chip tray on the gaming table and one or more antennas for electronically obtaining information from the gaming chips which are located in the chip tray. Preferably this antenna is carried by the chip tray.

Viewed from another perspective, the system of this invention may include first and second gaming chip placement surface regions on which gaming chips can be placed and associated first and second antennas. At least one of the gaming chip placement surface regions is on a gaming table. The system also includes an electronic system for receiving and storing the information from the antennas so that the location of the gaming chips can be tracked.

Another feature of the method of this invention is electronically identifying the value of gaming chips which have electronically identifiable values and which are at a first gaming chip placement area of a gaming table over a period of time. The values of the gaming chips at the first gaming chip placement area during such period of time are summed to provide a summed value, and this can be automatically accomplished.

There are several instances in which knowing the summed value is desirable. For example, the first gaming chip placement area may be a player's bet placement area, and the method may also include identifying the player who placed the gaming chips at the player's bet placement area during the applicable period of time. This enables the house to know the betting activity of the player, and this is important so that the house can award comps to the player. Although player identification can be accomplished in different ways, preferably it is carried out with a machine readable card associated with the player. Cards of this type are known and have been used for player identification for slot machines.

The summed value is also of interest in compiling the game operator's win-loss record against a particular player. This feature of the invention calls for identifying the game operator associated with the gaming table during the applicable period of time. Game operator identification can be ascertained such as by utilizing a machine readable card associated with the game operator.

The first gaming placement area may also be a chips for cash area. In this event, the method may also include identifying the game operator during the applicable period of time and comparing the cash received for gaming chips by the game operator and the summed value to provide a check on the game operator's handling of the gaming chips and money.

Another feature of this invention is to provide a camera for viewing a particular gaming table or tables and to actuate the camera in response to predetermined activity which would suggest that surveillance is advisable. For example, this activity may be the placing a bet in the player's bet placement area greater than a predetermined amount, increasing a bet from one game to the next by more than a predetermined amount or any other factor that the house may consider would justify surveillance. In each of these cases, the antenna associated with the player's bet placement area would provide a particular signal indicative of the activity that should be observed and the camera would be appropriately actuated in response to such signal. Thus, in monitoring the value of gaming chips at a gaming chip placement area, particular information may be obtained which results in camera actuation.

The invention, together with additional features and advantages thereof may best be understood by reference to the following description taken in connection with the accompanying illustrative drawings.

DESCRIPTION OF THE PREFERRED EMBODIMENTS

Figure 1:
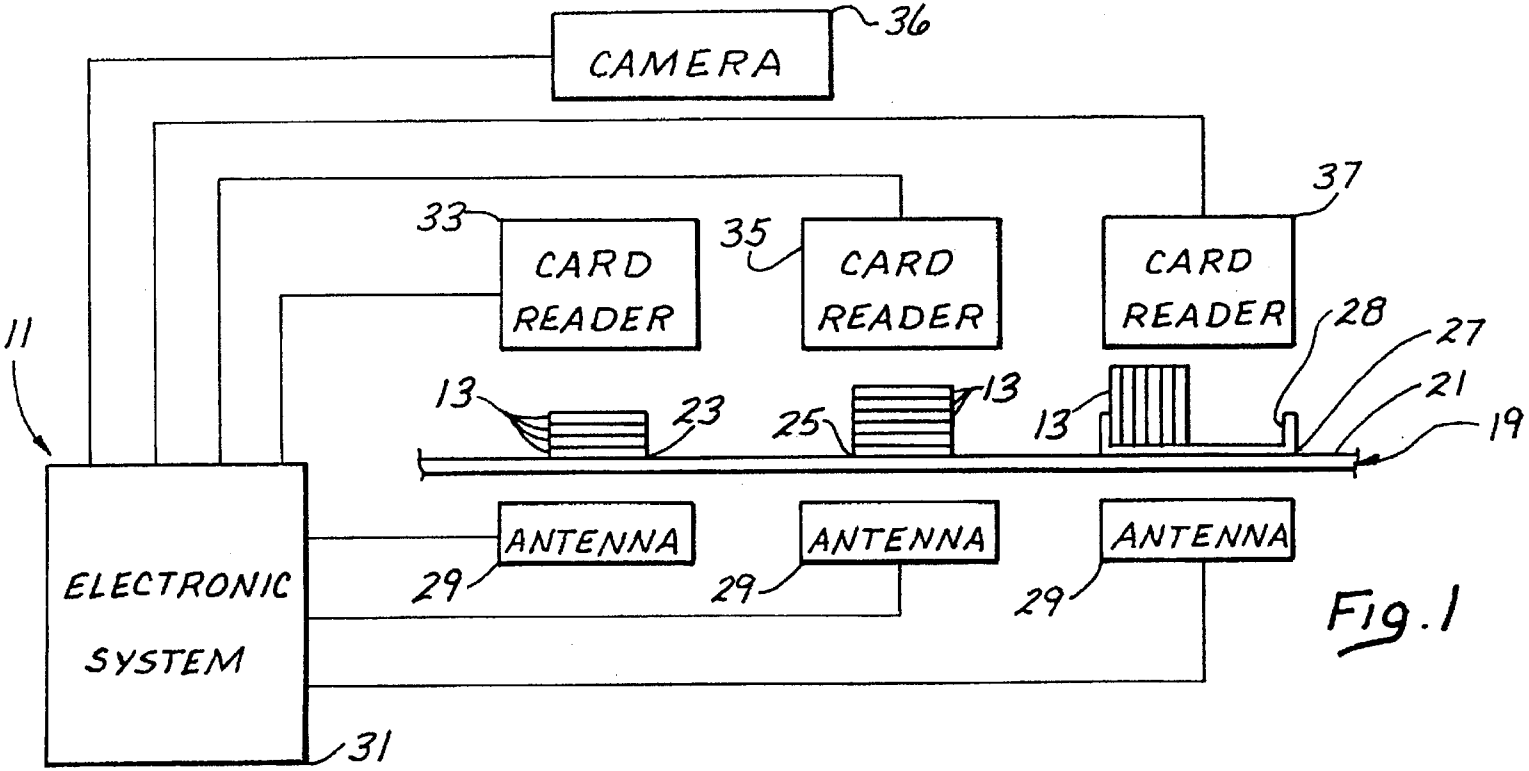
FIG. 1 is a schematic illustration of a system constructed in accordance with the teachings of this invention.
Figure 2:
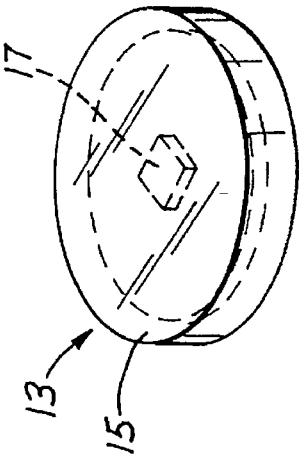
FIG. 2 is a somewhat schematic perspective illustration of a chip of the type usable with this invention.

FIG. 1 shows a system 11 for tracking movement of gaming chips 13 and for performing other valuable functions. The gaming chips 13 which are adapted for use with the present invention are electronically identifiable and carry electronically ascertainable information about the gaming chip. Generally, each of the gaming chips 13 (FIG. 2) includes a body 15 and an electronic tag or transponder 17 within and carried by the body. The tag 17 carries electronically ascertainable information about the chips such as the chip's identification number and the value of the chip in the casino. Each of the gaming chips 13 has its own identification number and so in that sense is unique. The tag 17 includes an electronic circuit which includes an electronic chip and an antenna. The tag 17 may also include a battery, which when activated would provide energy for transmitting a signal from the tag. When the tag 17 is interrogated by an appropriate signal from an antenna, it responds by sending a signal representative of the information stored in the circuit. Tags of this type and the associated equipment needed to obtain the information from the tags are known and are available, for example, from Telsor of Englewood, Colo.

However, the preferred tag 17 is of the type which permits batch scanning, i.e. scanning a whole group of the gaming chips 13 during one time interval with a radio beam. This beam illuminates all of the tags 17 and requires them to broadcast the electronically ascertainable information carried thereby. The radio beam provides energy to the tag or transponder 17, thereby enabling the tags to broadcast this information. This technology is available, for example, from British Technology Group, Ltd. of London as Supertag and from Advanced Systems Group International of Herndon, Va.

The system 11 includes a gaming table 19 (FIG. 1) having a surface 21 and gaming chips placement areas 23, 25 and 27. The gaming table 19 may be of any kind including the gaming tables referred to above. Any desired number of the gaming chip placement areas may be utilized, and the three illustrated in FIG. 1 are purely illustrative. The gaming chip areas 23, 25 and 27 may be at various different locations within the casino, such as on a gaming table, on a gaming chip tray, in the cashier's cage, in the casino vault, etc. In the example shown in FIG. 1, the gaming chip areas 23 and 25 are on the surface 21 of the gaming table 19 and the gaming chip placement area 27 is on a dealer's chip tray 28.

The system 11 also includes a plurality of antennas 29, one for each of the gaming chip areas 23, 25 and 27. The antennas 29 are cooperable with the tags 17 in the gaming chips 13 for obtaining information stored in the tags of the gaming chips at the associated gaming chip placement area. The antenna 29 transmits a radio beam which, in effect, scans the tags 17 of the chips 13 on the associated gaming chip placement area and requires the tags to broadcast the information stored in the tags. The antennas 29 also provide the tags 17 with the energy to accomplish this. The British Technology tag and system referred to above employ a protocol which prevents reader jamming that would tend to occur if a plurality of the tags 17 responded simultaneously to the command from the associated antenna. Consequently, each gaming chip 13 of the stack of gaming chips at, for example, the gaming chip placement area 23 can then be identified while all of such gaming chips are at such gaming chip placement area. A batch reading system such as this is preferred. However, single tag readers could be employed for games in which only a single gaming chip is placed on a gaming chip placement area.

The system 11 also includes an electronic system 31 which provides all of the other known functions to enable the antennas 29 to scan the tag 17 at the gaming chips 13 at the associated gaming chip placement area and to receive, process and store the information so obtained. The electronic system 31 is coupled to the antennas 29 and the location of each of the chips 13 when they are at the gaming chip placement areas 23, 25 and 27 is stored in the electronic system 31. Of course the electronic system 31 can be coupled to any number of antennas 29 which may be located at various different locations throughout the casino including at many gaming tables.

The electronic system 31 is also coupled to conventional card readers 33 placed in association with the gaming chip placement areas 23, 25 and 27, respectively. By inserting a machine readable identification card into one of the card readers 33, a signal is transmitted to the electronic system 31 identifying the person that is using the associated gaming chip placement area. For example, if a player inserts his card into the card reader 33, the system 11 knows the particular player utilizing the gaming chip placement area 23. If, for example, a game operator inserts his card into the card reader 35, the system 11 knows that it is that particular game operator who is responsible for the gaming chip placement area 25.

The electronic system 31 in addition to providing the necessary interface and reader functions common to the antenna-tag systems, also includes a computer for performing the various other data processing and related functions that are required. As such, the computer may be programmed in part in a manner similar to the computers now used for tracking various information as to slot machine playing activity referred to above.

The system 11 shown schematically in FIG. 1 can be used to provide a number of valuable functions in a casino. For example, the system 11 can be used to track the movement of gaming chips. This can be accomplished by electronically identifying each gaming chip 13 at, for example, the gaming chip area 23 so that the electronic system 31 knows specifically which chips are at the gaming area 23. If one or more of the those chips should be moved to another gaming chip placement area, such as the area 25, that chip can then be electronically identified utilizing the associated antenna 29. Consequently, the movement of the gaming chips from the area 23 to the area 25 as well as to other gaming chip areas within the casino can be accomplished.

The system 11 can also be used to identify the value of the gaming chips 13 which are at each of the gaming chip placement areas 23, 25 and 27. The electronic system 31 has a processor which sums the values of the gaming chips at each of these gaming chip placement areas during a given time period. Consequently, if the gaming chip placement area 23 is a player's bet placement area, the total value of chips played by a player identified by the associated card reader 33 over a given time period can be ascertained. In addition, by identifying the game operator associated with the game table 27 utilizing, for example, the card reader 37 and the game operator's identification card, the electronic system 31 can compile and store the game operator's win-loss record and average bet as well as the game operator's win-loss record against each of the player's at the game table 19.

The system 11 may also include a camera 36 coupled to the electronic system 31. The electronic system 31 will turn the camera on in response to a particular signal or information obtained from any one or more of the antennas 29. For example, the camera 36 may be activated by the electronic system 31 in response to a signal from the antenna 29 indicating that the gaming chip placement area 23 has more than a predetermined value of chips. The camera 36 will be trained on at least the gaming table 19 or the portion of the gaming table which gave rise to the signal which called for surveillance.

Figure 3:
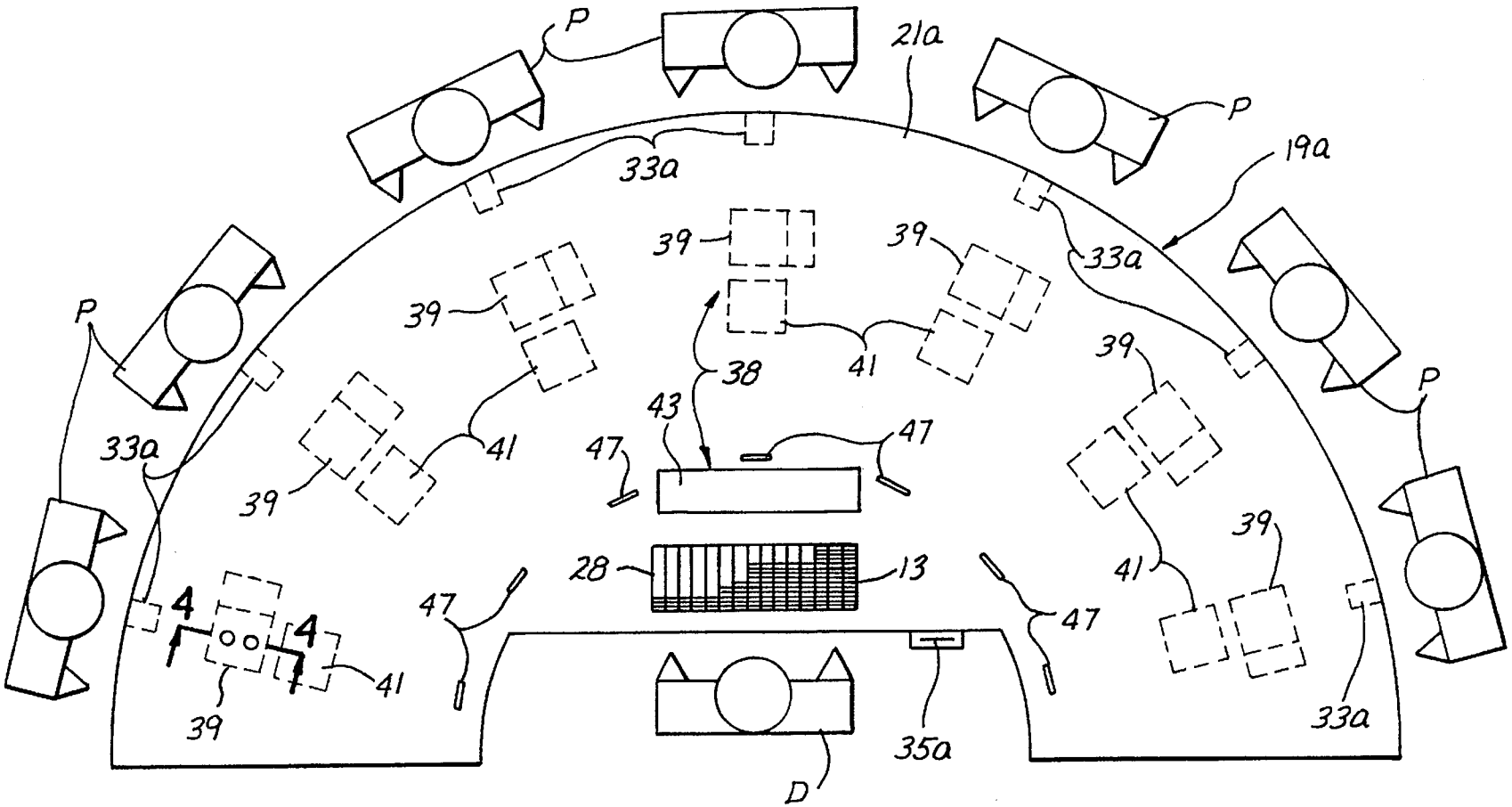
FIG. 3 is a schematic plan view of a blackjack table constructed in accordance with the teachings of this invention.

FIG. 3 shows a gaming table **19*a* in the form of a blackjack table. The blackjack table 19*a* can be used in the system of FIG. 1 in place of the schematically illustrated gaming table 19 and many portions of the blackjack table 19*a* corresponding to portions of the gaming table 19 are designated by corresponding reference numerals followed by the letter "a". The blackjack table 19*a* may be of a conventional generally semicircular configuration in plan and its upper surface 21*a* may have indicia 38 that adapts the surface 21*a* for playing blackjack. The indicia 38 may provide, for example, a variety of gaming chip placement areas including player bet placement areas 39 and player win placement areas 41 for players P. The areas 39 and 41 are arranged in pairs with one pair being provided for each playing station, and seven such playing stations are shown in FIG. 3. Also associated with each player station is a card reader 33 which may, if desired, be mounted on the table 19*a***.

The table **19*a* also has a game operator or dealer station and a card reader 35*a* at the dealer station for identification of a dealer D. The indicia 38 on the surface 21*a* also provide a gaming chip placement area in the form of chips for cash area 43. The chip tray 28 containing gaming chips 13 is also provided at the dealer station. The table 19*a* may also include a plurality of bet amount displays 47 associated with the player stations, respectively, to automatically display the value of the gaming chips placed in the player bet placement areas 39**.

The areas 39, 41 and 43 are indicated by appropriate lines or marks on the upper surface **21*a* of the gaming table 19*a***.

Figure 4:
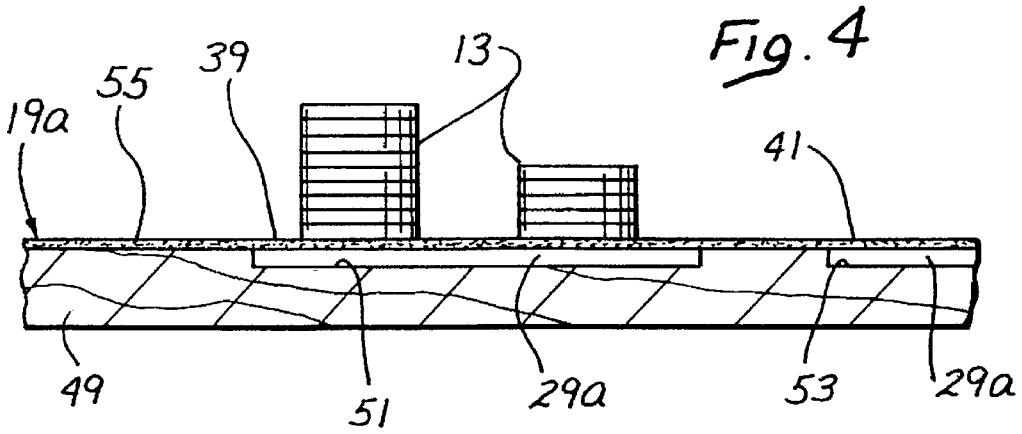
FIG. 4 is an enlarged fragmentary sectional view taken generally along line 4—4 of FIG. 3.

However, in order to obtain information from gaming chips on these areas, it is necessary that one antenna be provided for each of these areas and preferably positioned closely adjacent to the associated area. FIG. 4 shows a preferred construction in which the gaming table 19*a* comprises a horizontal top member 49 of a suitable material and having upwardly opening cavities 51 and 53 for receiving antennas 29*a*, respectively. The top member 49 is covered with a layer 55 of felt or other suitable material, and this material also covers the cavities 51 and 53 and the antennas 29*a*. The indicia 38 which define the gaming chip placement areas 39 and 41 is provided on the felt. A similar construction can be employed for the placement of an antenna in the top member 29 beneath the layer 55 at the chips for cash area 43.

In use, the antennas 29*a* for each of the areas 39, 41 and 43 and the card readers 33*a* and 35*a* are suitably coupled to the electronic system 31 of FIG. 1. Consequently, the identity of each of the players and of the game operator is known as well the amount bet by each of the players on the associated bet placement area 39. The value of the current bet for an area 39 is known by the system 31 and is displayed by the display 41. If desired, the winnings of the players can be tracked by summing the value of chips placed on the player win placement areas 41 and the dealers overall win-loss record can be tracked as well as the dealer's win-loss record for each of the players in the game. In addition, when a player buys chips, the dealer removes chips from the chip tray 45 and places them on the chips for cash area 43 and the total value of chips placed on the chips for cash area 43 over a period of time can be summed by the electronic system 31. The total value of chips placed on the area 43 should equal the cash received by the dealer during his tenure at the table 19*a*.

Figure 5:
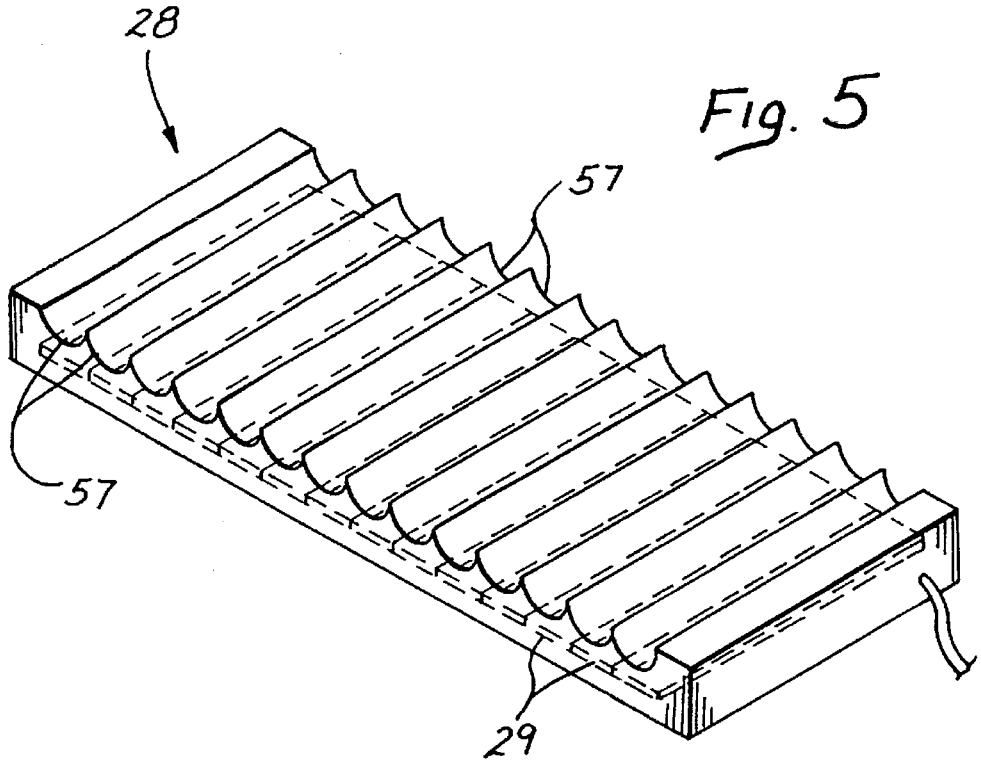
FIG. 5 is a perspective view of a chip tray constructed in accordance with the teachings of this invention.

The gaming chips 13 placed into and removed from the chip tray 28 can also be monitored by placing one or more of the antennas 29 in the chip tray 28 (FIG. 5). The chip tray 28 may be conventional to the extent that it has a series of parallel grooves 57 sized to receive and store the gaming chips 13. The chip tray 28 departs from the conventional in having a plurality of the antennas 29 within and carried by the tray. In the form shown in FIG. 5, one of the antennas 29 is provided beneath each of the grooves 57 for detecting of the gaming chips 13 in the associated groove. The antennas 29 of the chip tray 28 are also coupled to electronic system 31 so that the identity and value, including the total value, of the gaming chips in the tray 28 is known by the system 11.

Figure 6:
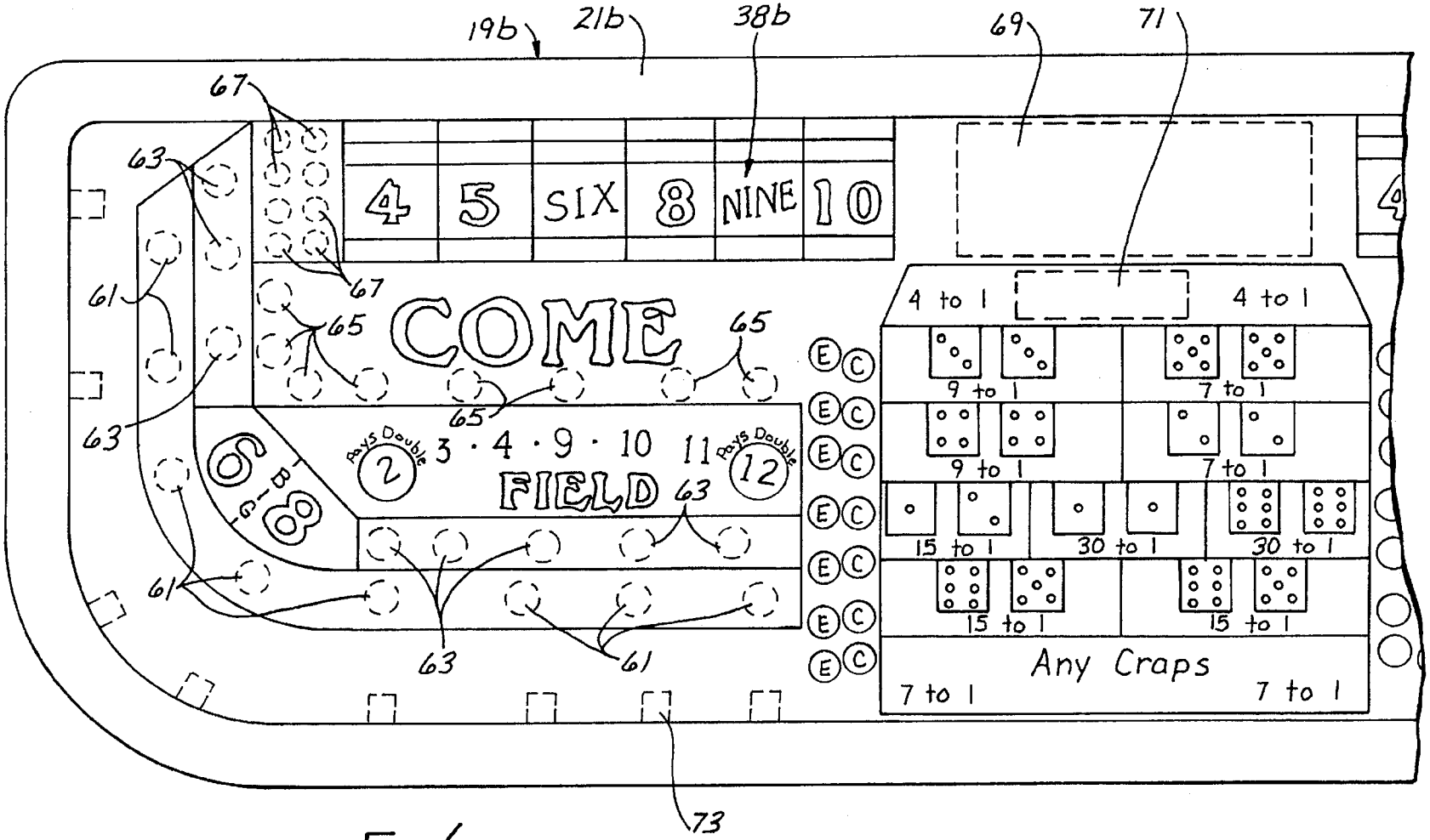
FIG. 6 is a fragmentary plan view of a craps table constructed in accordance with the teachings of this invention.

FIG. 6 shows one way in which the system 11 can be adapted for craps. FIG. 6 shows a craps table 19*b* which can be used in the system of FIG. 1 in place of the schematically illustrated gaming table 19. The craps table 19 may be of a conventional configuration in plan and its upper surface 21*b* had indicia 38*b* which adapts the surface 21*b* for craps. In addition, the indicia 38*b* defines a number of bet placement areas suitable for craps. Specifically, the indicia 38*b* provides pass line bet placement areas 61, don't pass bet placement areas 63, come bet placement areas 65 and don't come bet placement areas 67. The craps table 19*b* shown in FIG. 6 has a second set of the bet placement areas 61, 63, 65 and 67 There are 8 sets of the bet placement areas 61, 63, 65 and 67, one for each player position at the table 19*b*. There is also an antenna beneath each of the areas 61, 63, 65 and 67 and this construction may be substantially as shown byway of example in FIG. 4.

The indica 38*b* also defines a chip storage area 69 where the chips of the house are stored and a chips for cash area 71. The area 69 is in lieu of the chip tray and the chips for cash area 71 is much like the chips for cash area 43 described above in connection with FIG. 5. Thus, one or more antennas may be imbedded in the table 19*b* as shown by way of example in FIG. 4 beneath the areas 69 and 71 to enable identifying and determining the value of the chips in these two areas. Card readers 73 may be used to read the identification cards of the players at the table 19*b* with one of such card readers being provided for each of the player stations. The other portions of the table 19*b* may be conventional for a craps table.

By utilizing the table 19*b* and the system 11, the amount bet by each player can be determined and the total value of chips sold by the game operator is also automatically tracked. Because the chips at each of the chip placement areas on any of the gaming tables are identified, the movement of the chips from one chip placement area to the next can be tracked.

Although exemplary embodiments of the invention have been shown and described, many changes, modifications and substitutions may be made by one having ordinary skill in the art without necessarily departing from the spirit and scope of this invention.

We claim:

1. An apparatus comprising:

a plurality of gaming chips, each having an electronic circuit capable of transmitting information;

a gaming table having a game playing surface, said surface having indicia thereon adapting said surface for a game which uses at least one of said plurality of gaming chips;

said surface having at least one gaming chip placement area therein; and an antenna for obtaining information from a gaming chips located on said gaming chip placement area.

2. An apparatus as defined in claim 1 wherein said antenna has a capability for obtaining information from each of said plurality of gaming chips located on said gaming chip placement area.

3. An apparatus as defined in claim 1 wherein the antenna is carried by the gaming table closely adjacent the gaming chip placement area.

4. An apparatus as defined in claim 1 wherein the antenna is carried by the gaming table beneath the gaming chip placement area.

5. An apparatus as defined in claim 1 wherein said surface has a plurality of gaming chip placement areas and includes a plurality of antennas for obtaining information from said plurality of gaming chips located on associated gaming chip placement areas.

6. An apparatus as defined in claim 5 wherein the indicia adapts said surface for blackjack with n player positions, a first group of said gaming chip placement areas includes n player bet placement areas and a second group of said gaming chip placement areas includes n player win placement areas located adjacent the player bet placement areas respectively, whereby information from the gaming chips being bet and the gaming chips being paid to a player can be obtained.

7. An apparatus as defined in claim 5 wherein the gaming table is a craps table, a first group of said gaming chip placement areas includes n player bet placement areas and a first of said gaming chip placement areas is a gaming chip storage area whereby information from the gaming chips being bet and the gaming chips held at the gaming chip storage area can be obtained.

8. An apparatus as defined in claim 5 including a chip tray on the gaming table and an antenna for electronically obtaining information from each of the plurality of gaming chips which is in the chip tray.

9. An apparatus as defined in claim 8 wherein the last mentioned antenna is carried by the chip tray.

10. An apparatus a defined in claim 1 including an electronic system for receiving an storing the information from the antenna about at least some of the plurality of gaming chips.

11. An apparatus as defined in claim 1 including a camera and means responsive to a particular signal from the antenna for actuating the camera.

12. A method of tracking movement of a plurality of gaming chips, each having an electronic circuit which can transmit identifying information about the gaming chip, in a casino comprising:

electronically identifying each of said plurality of gaming chips at a first gaming chip placement area within the casino using an electronic system in electrical connection with a first antenna which can process information transmitted from said plurality of gaming chips at said first gaming chip placement area;

moving a first gaming chip of said plurality of gaming chips to a second gaming chip placement area within the casino; and electronically identifying said first gaming chip at the second gaming chip placement area within the casino using the electronic system in electrical connection with a second antenna which can process information transmitted from said first gaming chip at the second gaming chip placement area whereby the location of said first gaming chip is tracked.

13. A method as defined in claim 12 wherein there is a second gaming chip of said plurality of gaming chips on the second gaming chip placement area and the second mentioned step of electronically identifying includes electronically identifying the first and second gaming chips while both the first and second gaming chips are at the second gaming chip placement area.

14. A method as defined in claim 12 wherein the first gaming chip placement area is on a gaming table.

15. A method as defined in claim 12 wherein the first gaming chip placement area is on a gaming chip tray.

16. A method as defined in claim 12 which includes storing in a memory the location of the first gaming chip using the electronic system.

17. A system for tracking movement of a plurality of gaming chips wherein each of the plurality of gaming chips has an electronic circuit capable of carrying and transmitting ascertainable information about the gaming chip, said system comprising:

first and second gaming chips placement surface regions on which at least some of the plurality of gaming chips can be placed;

first and second antennas for obtaining information from each of the plurality of gaming chips at the first and second gaming chip placement surface regions, respectively;

a gaming table, at least the first gaming chip placement surface region being on the gaming table; and an electronic system for receiving and storing the information from the first and second antennas about the gaming chips on the first and second gaming chip placement surface regions whereby the location of the gaming chips on the first and second gaming chip placement surface regions can be tracked.

18. A method comprising:

electronically monitoring a total value of a plurality of gaming chips, each of which has an electrical circuit capable of transmitting information about the value of the gaming chip and at least some of which are at a first gaming chip placement area of a gaming table over a period of time; and summing the values of each of the plurality of gaming chips at the first gaming chip placement area during said period of time using an electronic system which monitors and sums the values of gaming chips, to provide a summed value.

19. A method as defined in claim 18 wherein the first gaming chip placement area is a player's bet placement area and said method includes identifying a player who places the gaming chips at the player's bet placement area during said period of time whereby the betting activity of the player is known.

20. A method as defined in claim 19 wherein said step of identifying is carried out, at least in part, by a card reader in conjunction with a machine readable card associated with the player.

21. A method as defined in claim 19 including electronically monitoring the total value of the plurality of gaming chips and wherein the gaming chip placement area is a player win placement area, summing the values of the plurality of gaming chips at the player win placement area during said period of time to provide a summed value, identifying a game operator associated with the gaming table during said period of time and compiling a game operator's win-loss record against a player associated with the player win placement area.

22. A method as defined in claim 18 wherein the first gaming chip placement area is a chips for cash area and said method further includes identifying a game operator associated with the gaming table during said period of time and comparing the cash received for gaming chips by the game operator and said summed value.

23. A method as defined in claim 22 wherein the step of identifying the game operator is carried out, at least in part, by a card reader in conjunction with a machine readable card associated with the game operator.

24. A method as defined in claim 18 including actuating a camera in electrical connection with the electronic system for viewing a region near the first gaming chip area in response to particular information obtained in said step of monitoring.

* * * * *